US007200884B2

(12) United States Patent
Wright et al.

(10) Patent No.: US 7,200,884 B2
(45) Date of Patent: Apr. 10, 2007

(54) MATTRESS ASSEMBLY AND MANUFACTURING PROCESS FOR A MATTRESS USING ADHESIVE PATCHES

(75) Inventors: Richard S. Wright, Fayetteville, GA (US); Timothy F. Watson, Dallas, GA (US)

(73) Assignee: Dreamwell Ltd., Las Vegas, NV (US)

( * ) Notice: Subject to any disclaimer, the term of this patent is extended or adjusted under 35 U.S.C. 154(b) by 173 days.

(21) Appl. No.: 10/965,355

(22) Filed: Oct. 14, 2004

(65) Prior Publication Data

US 2005/0081298 A1 Apr. 21, 2005

Related U.S. Application Data

(60) Provisional application No. 60/512,496, filed on Oct. 17, 2003.

(51) Int. Cl.
*A47C 27/00* (2006.01)
*B68G 7/00* (2006.01)

(52) U.S. Cl. ..... 5/717; 5/739; 5/740; 5/716; 29/91.1

(58) Field of Classification Search ..... 5/716, 5/717, 720, 721; 156/290, 291; 29/91, 91.1, 29/91.7

See application file for complete search history.

(56) References Cited

U.S. PATENT DOCUMENTS

| | | | | |
|---|---|---|---|---|
| 2,862,214 | A | 12/1958 | Thompson | |
| 3,191,197 | A | 6/1965 | Frey | |
| 3,262,135 | A | 7/1966 | Fasanella | |
| 3,429,767 | A * | 2/1969 | Bronstien, Jr. et al. | 156/165 |
| 3,869,739 | A | 3/1975 | Klein et al. | |
| 4,015,299 | A | 4/1977 | Tinnel | |
| 4,167,049 | A | 9/1979 | Fogel | |
| 4,346,489 | A | 8/1982 | McMullan | |
| 4,389,741 | A | 6/1983 | Larson | |
| 4,970,743 | A | 11/1990 | Wride et al. | |
| 5,040,255 | A | 8/1991 | Barber, Jr. et al. | |
| 5,138,730 | A | 8/1992 | Masuda | |
| 5,511,260 | A | 4/1996 | Dinsmoor, III et al. | |
| 5,657,500 | A | 8/1997 | Messina | |
| 5,960,496 | A | 10/1999 | Boyd | |
| 6,212,720 | B1 | 4/2001 | Antinori et al. | |
| 6,662,393 | B2 | 12/2003 | Boyd | |
| 2003/0000021 | A1 | 1/2003 | O'Connell et al. | |
| 2003/0019043 | A1 | 1/2003 | Bryant et al. | |
| 2005/0000026 | A1 * | 1/2005 | Gladney | 5/717 |
| 2005/0081301 | A1 * | 4/2005 | Watson | 5/739 |

FOREIGN PATENT DOCUMENTS

| | | |
|---|---|---|
| EP | 0629369 | 12/1994 |

* cited by examiner

*Primary Examiner*—Michael Trettel
(74) *Attorney, Agent, or Firm*—Fish & Neave IP Group Ropes & Gray LLP

(57) ABSTRACT

A mattress and a method of manufacturing a mattress are disclosed. The mattress includes a mattress core, a side rail joined to the mattress core by a one or more adhesive patches, optionally a deck applied over an area of the mattress core and joined to the mattress core by adhesive patches, and an upholstery layer defining a sleep surface applied over the deck or the mattress core and joined to the deck by adhesive patches. The adhesive patches have a bonding strength sufficient to maintain a relative position between the various mattress components at least during assembly of the mattress. The upholstery layer is permanently secured to the side rail by, for example, sewing or stapling.

23 Claims, 9 Drawing Sheets

MATTRESS ASSEMBLY AND MANUFACTURING PROCESS FOR A MATTRESS USING ADHESIVE PATCHES

CROSS-REFERENCE TO OTHER PATENT APPLICATIONS

This application claims the benefit of U.S. provisional Patent Application No. 60/512,496, filed Oct. 17, 2003, the content of which is incorporated herein by reference in its entirety.

BACKGROUND OF THE INVENTION

The present invention relates to mattress construction and a manufacturing process for a mattress that facilitates placement of the various mattress components before the mattress is closed by sewing.

Generally, mattresses are formed with a mattress central portion surrounded by a mattress border construction. The mattress central portion may include a series of coil springs connected together, which can be enclosed in fabric pocket. Such springs are also referred to as Marshall springs. Alternatively, the mattress central portion may comprise polyurethane or latex foam layers or synthetic or natural fibers, optionally in combination with springs. To provide sufficient support and to make the mattress more robust, mattress manufacturers have introduced mattresses with a foam-encased innercore that gives greater edge support. The foam edge is typically glued to a support layer and the coil unit is joined to the support layer by a border wire and hog rings. At least the sleeping surface of the mattress is typically covered with a quilted fabric.

When manufacturing the mattress, the innerspring unit is typically attached to a lower border wire and that border wire is joined to the support layer. The foam edge is glued in place around the innerspring unit. The quilted fabric is then attached to side panels by sewing.

Although such mattresses and manufacturing processes work well, there is a need in the art for improved techniques for manufacturing mattresses that are easier to manufacture by enabling an accurate and secure placement of the various mattress components before the mattress is closed by sewing.

SUMMARY OF THE INVENTION

The systems and methods described herein include improved mattresses and techniques for manufacturing such mattresses.

According to one aspect of the invention, a method of manufacturing a mattress includes the steps of providing a mattress core, at least one side rail, and at least one upholstery cover defining a sleep surface, placing adhesive patches on surfaces of the at least one side rail and the mattress core, and at least temporarily attaching with the adhesive patches the at least one side rail to lateral surfaces of the mattress core to hold the side rails in place relative to the mattress core during assembly of the mattress. The method further includes at least temporarily attaching with the adhesive patches the at least one upholstery cover to a major surface of the mattress core to hold the at least upholstery cover in place relative to the mattress core during assembly of the mattress, and thereafter permanently attaching an edge portion of the mattress cover to an edge portion of the at least one side rail.

According to another aspect of the invention, a mattress includes a mattress core, at least one side rail joined to the mattress core by one or more adhesive patches having a bonding strength sufficient to maintain a relative position between the mattress core and the at least one side rail at least during assembly of the mattress, at least one deck applied at least over an area of the mattress core and joined to the mattress core by one or more adhesive patches having a bonding strength sufficient to maintain a relative position between the mattress core and the at least one deck at least during assembly of the mattress, and an upholstery layer defining a sleep surface applied over the at least one deck and joined to the at least one deck by one or more adhesive patches having a bonding strength sufficient to maintain a relative position between the at least one deck and the upholstery layer at least during assembly of the mattress. The upholstery layer is permanently secured to the at least one side rail by an mechanical fastener.

Embodiments of the invention may includes, among other things, one or more of the following features. The adhesive patches may be two-sided adhesive patches to simplify a number of steps in manufacturing. Pre-extruded rubber based pressure sensitive adhesive patches may also be employed for attachment of various constituent pieces and subassemblies of a mattress to provide a simplified mattress construction. Adhesive patches may be provided on a roll of non-stick backing to permit simple removal by hand or by contact to the mattress components. Patches may be cut from the roll in individual lengths of non-stick backing, or deployed directly from the roll of non-stick backing by applying to work surface.

For example, adhesive patches may be employed for attachment of: (1) bottom or top finished panels on a mattress to a mattress core or inner mattress construction, (2) top upholstery foams to pocket coil innerspring units and foam side rails, (3) top upholstery foams to the top upholstery foams or other additional decks in a mattress using an offset-V or pillow sewn top, (4) between strata of top upholstery foams or other layers, (5) between bottom upholstery foam and pocket coil innerspring units and foam side rails, (6) foam or other side rails to a pocket coil innerspring unit, (7) side rails to other side rails in corners of a mattress.

More generally, adhesive patches may be sized and placed in any fashion that reduces cost and/or improves mattress design, with the details depending on the mattress construction designs. This technique may eliminate the need for mechanical fasteners, water and solvent spray glues, acrylic adhesive films, hook and loop fastening, and any other techniques requiring additional hardware or additional assembly time in the mattress manufacturing process.

Instead of using adhesive patches with lateral dimensions that are substantially less than a dimension of the mattress, the adhesive patch may actually be applied in form of a tape having a length that are substantially equal to the length and/or width of the mattress or a component of the mattress, such as the matress core or the side rail(s).

The mattress core can be an open coil mattress core, a fabric-encased spring coil mattress core, or springs disposed in foam mattress core. Alternatively, the mattress core can be one or more blocks of resilient foam that can have different firmness.

Further features and advantages of the present invention will be apparent from the following description of preferred embodiments and from the claims.

BRIEF DESCRIPTION OF THE DRAWINGS

The following figures depict certain illustrative embodiments of the invention in which like reference numerals refer to like elements. These depicted embodiments are to be understood as illustrative of the invention and not as limiting in any way.

DESCRIPTION OF THE ILLUSTRATED EMBODIMENTS

To provide an overall understanding of the invention, certain illustrative practices and embodiments will now be described, including a manufacturing process for a mattress that attaches an innerspring or coil unit to a side rail, upholstery foam and/or top panels for placement before the mattress is closed by sewing. However, it will be understood by one of ordinary skill in the art that the systems and methods described herein can be adapted and modified and applied in other applications and that such other additions, modifications and uses will not depart from the scope hereof.

Figure 1:
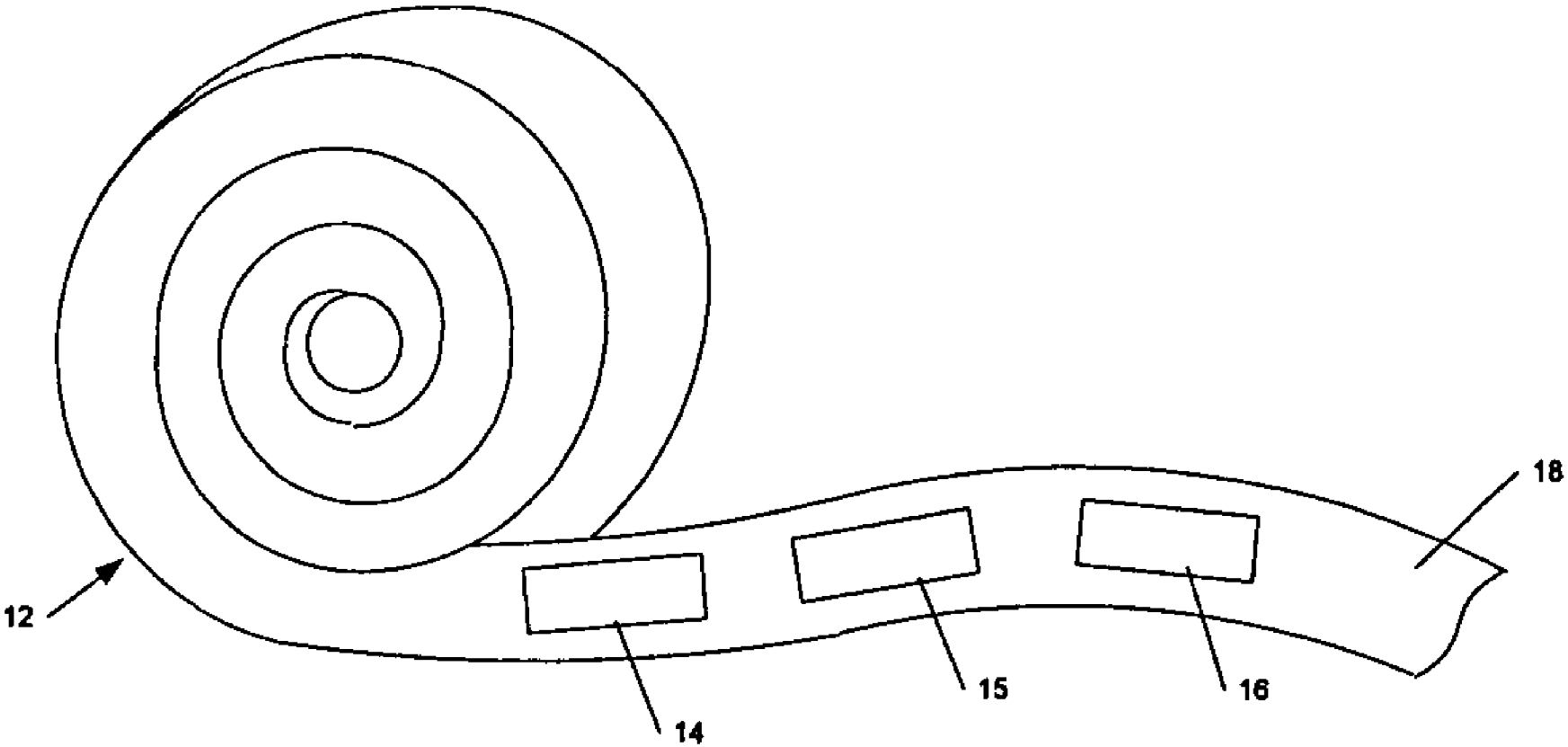
FIG. 1 shows a roll with a supply of patches.

FIG. 1 depicts schematically an exemplary roll 12 with adhesive patches 14, 15, 16 to be used for at least temporarily attaching various constituent pieces and subassemblies of a mattress, before they are sewn together, to provide a simplified mattress construction. Adhesive patches may have double-sided adhesive and may be provided on a roll of non-stick backing 18 to permit simple removal by hand or by contact to a mattress component. Patches may be cut from the roll in individual lengths of non-stick backing, or deployed directly from the roll of non-stick backing by applying to the mattress component. The adhesive patches may be sized and placed in any fashion that reduces cost and/or improves mattress design. For example, the adhesive patches may have a length that is substantially equal to the length or width of the mattress or any component used in the construction of the mattress. The patches may also be provided in the form of pre-extruded rubber-based pressure sensitive adhesive patches (not shown).

Figure 2:
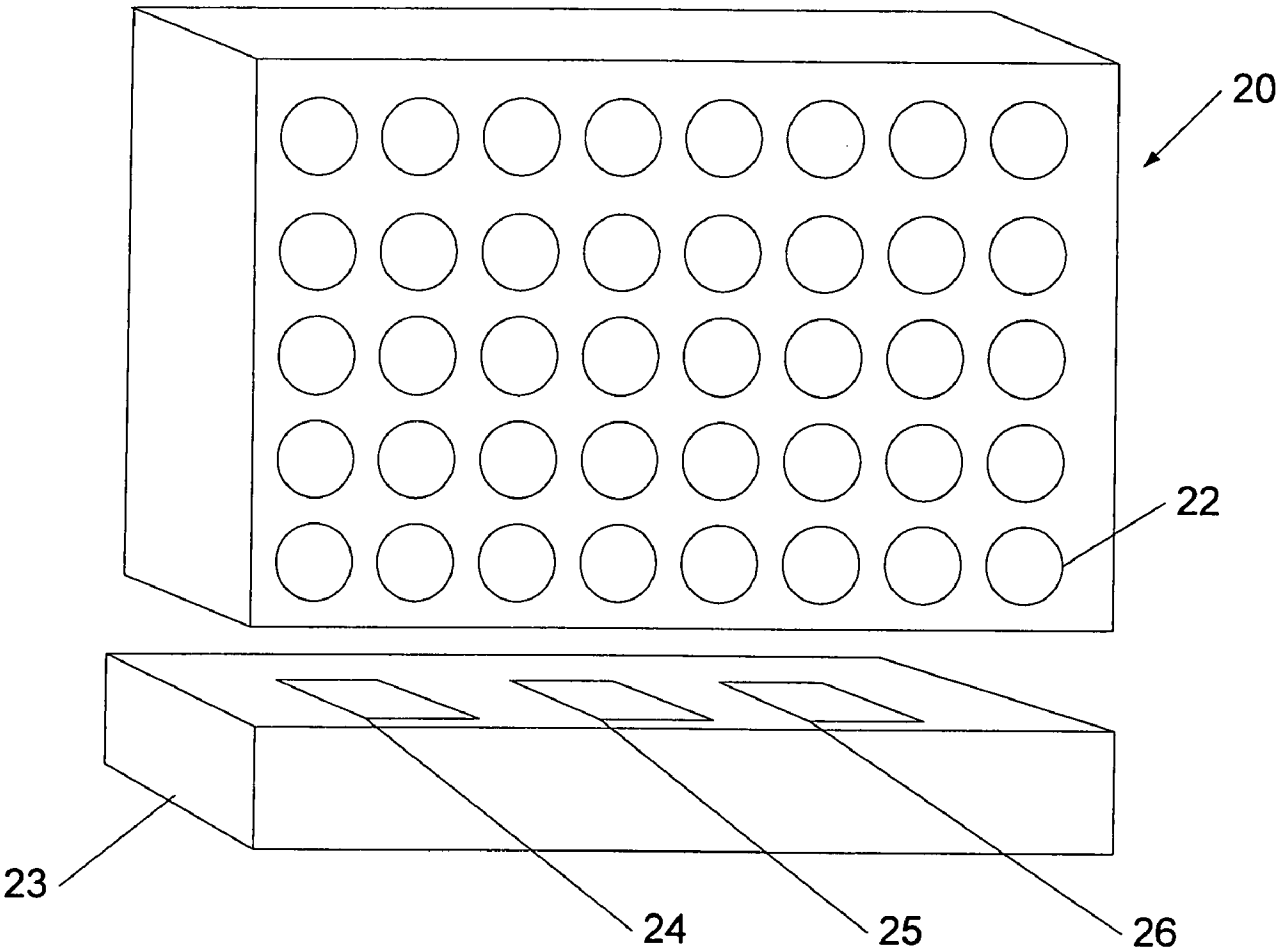
FIG. 2 illustrates a pocketed coil innerspring unit and a side rail with applied patches.

FIG. 2 is a perspective view of an exemplary pocketed innerspring unit 20 (mattress core) having pocketed (Marshall) coil springs arranged in rows. Instead of pocketed coil springs, the innerspring unit can also have an open coil mattress core or a foam mattress core. Bordering the outer row 22 of the coil springs is a side rail 23 made, for example, of foam or another suitable material known to those skilled in the art. Adhesive patches 24, 25, 26 of a type described above with reference to FIG. 1 can be applied to the side rail 23 or to the fabric covering the outer row 22 of springs, or both. The spacing between the patches and the size of the patches can be selected so that the side rail 23 adheres to the outer row 22 of springs at least during the assembly process of the mattress.

Figure 3:
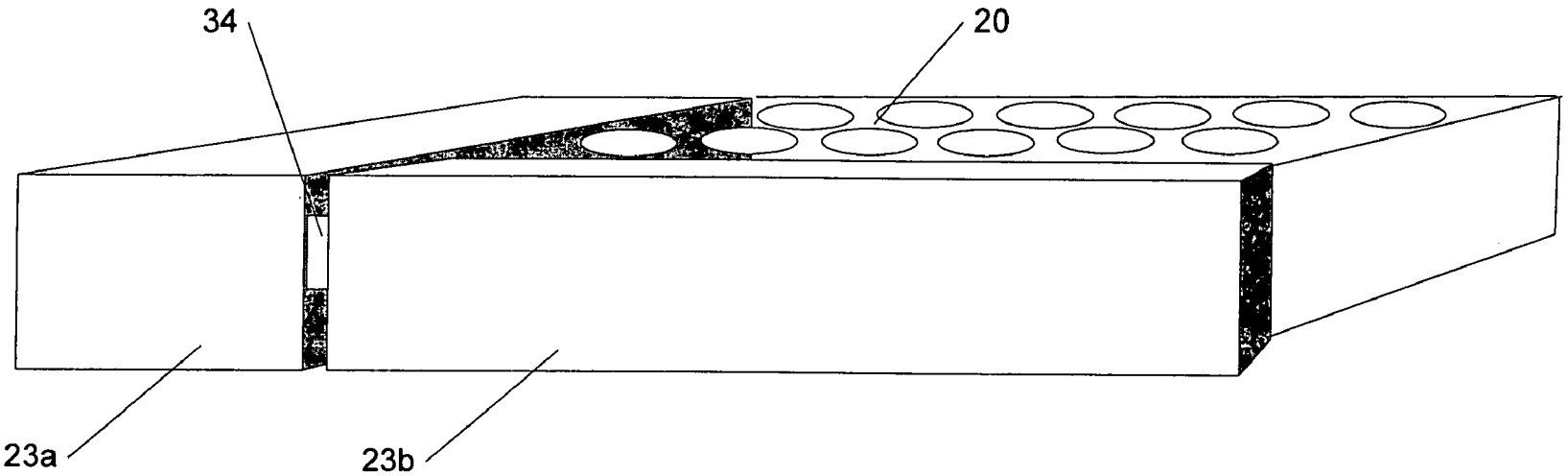
FIG. 3 illustrates a side rail attached to the innerspring unit.

FIG. 3 shows a perspective view of the mattress assembly, with two side rails 23*a*, 23*b* being attached to the innerspring unit 20. A patch 34 joining the respective corners of the side rails 23*a*, 23*b* is visible at the front. Those skilled in the art will appreciate that a plurality of side rails can be provided to substantially surround the lateral sides of the innerspring unit 20; alternatively, the side rail surrounding the innerspring unit 20 may be made of a single piece made, for example, by an extrusion process.

Figure 4:
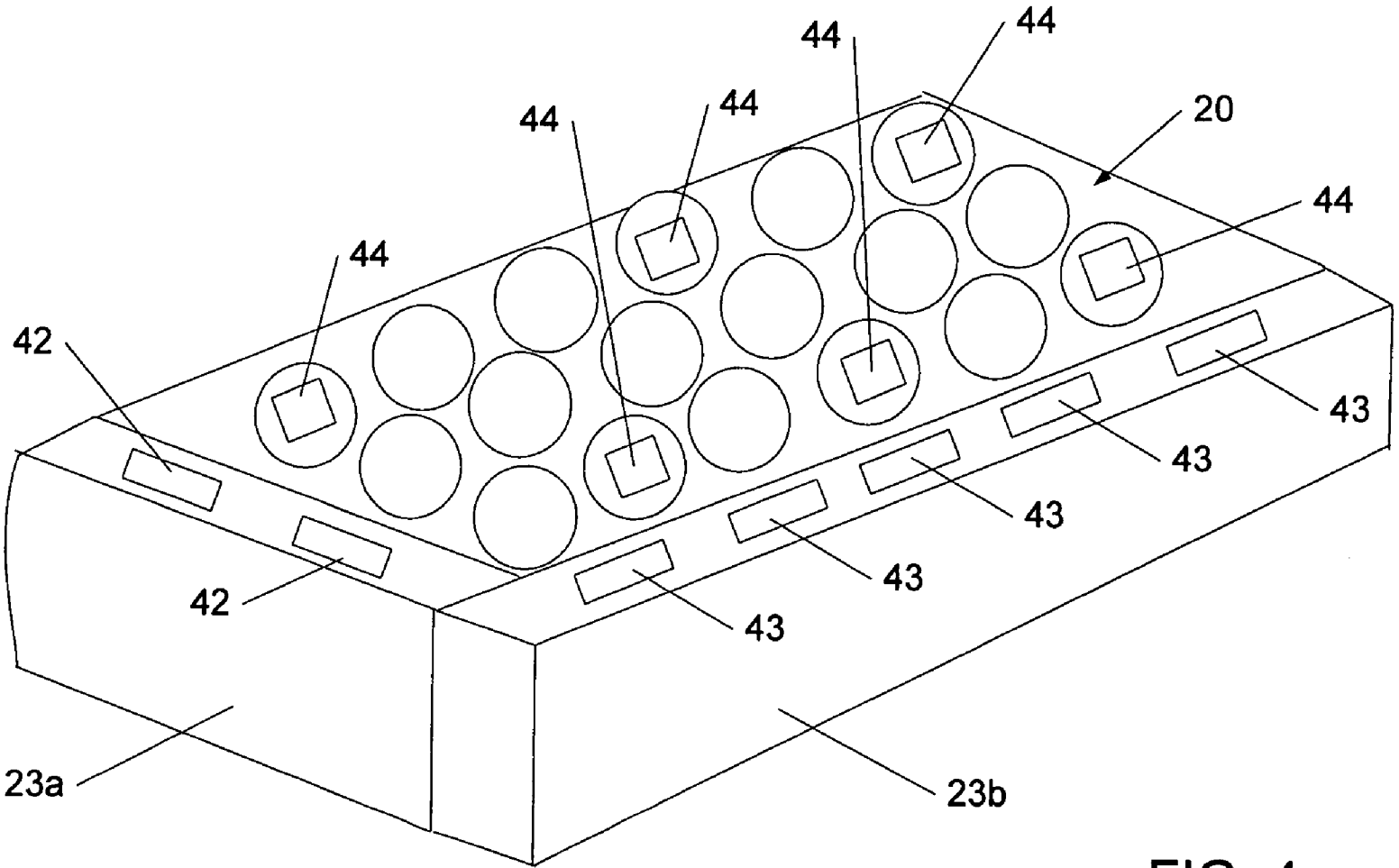
FIG. 4 shows adhesive patches applied to side rail and innerspring unit.
Figure 5:
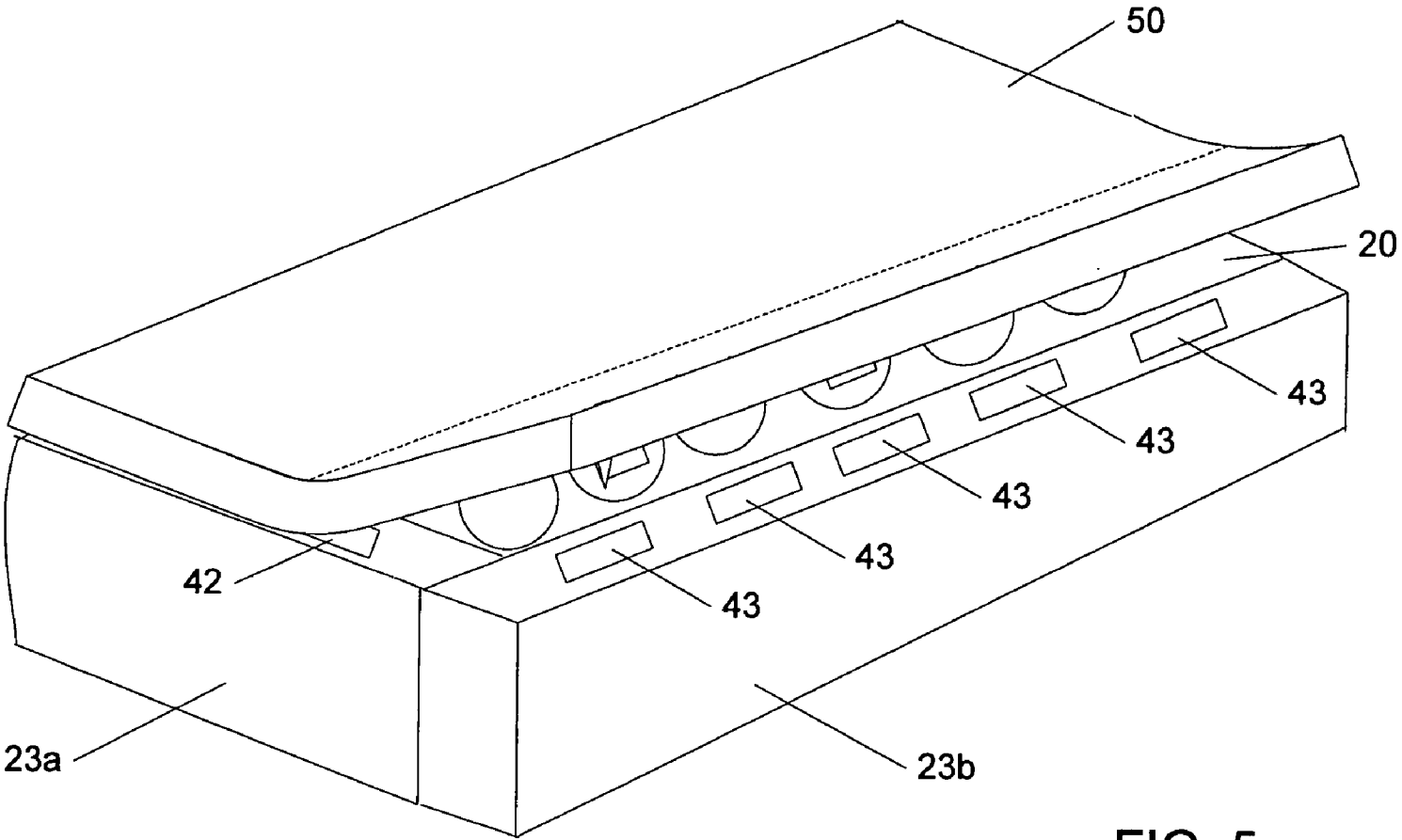
FIG. 5 shows application of a top deck to the innerspring unit.

Referring now to FIG. 4, after the side rails (only side rails 23*a*, 23*b* visible in FIG. 4) have been placed around and at least temporarily secured with the periphery of the innerspring unit 20, additional adhesive patches 42, 43 are applied to the top of the side rails 23*a*, 23*b*, and adhesive patches 44 are applied to the top 40 of innerspring unit 20. The adhesive patches 42, 43, 44 need not be uniformly spaced and are used to at least temporarily secure an upholstery foam topper 50, also referred to as a deck 50, in place, as illustrated in FIG. 5. In an alternative embodiment, patches 42, 43 could also be a continuous strip of double-sided adhesive tape extending substantially from one side of the innerspring unit 20 and/or the rails 23*a*, 23*b* to the other side of the respective innerspring unit 20 or rails 23*a*, 23*b*.

Figure 6:
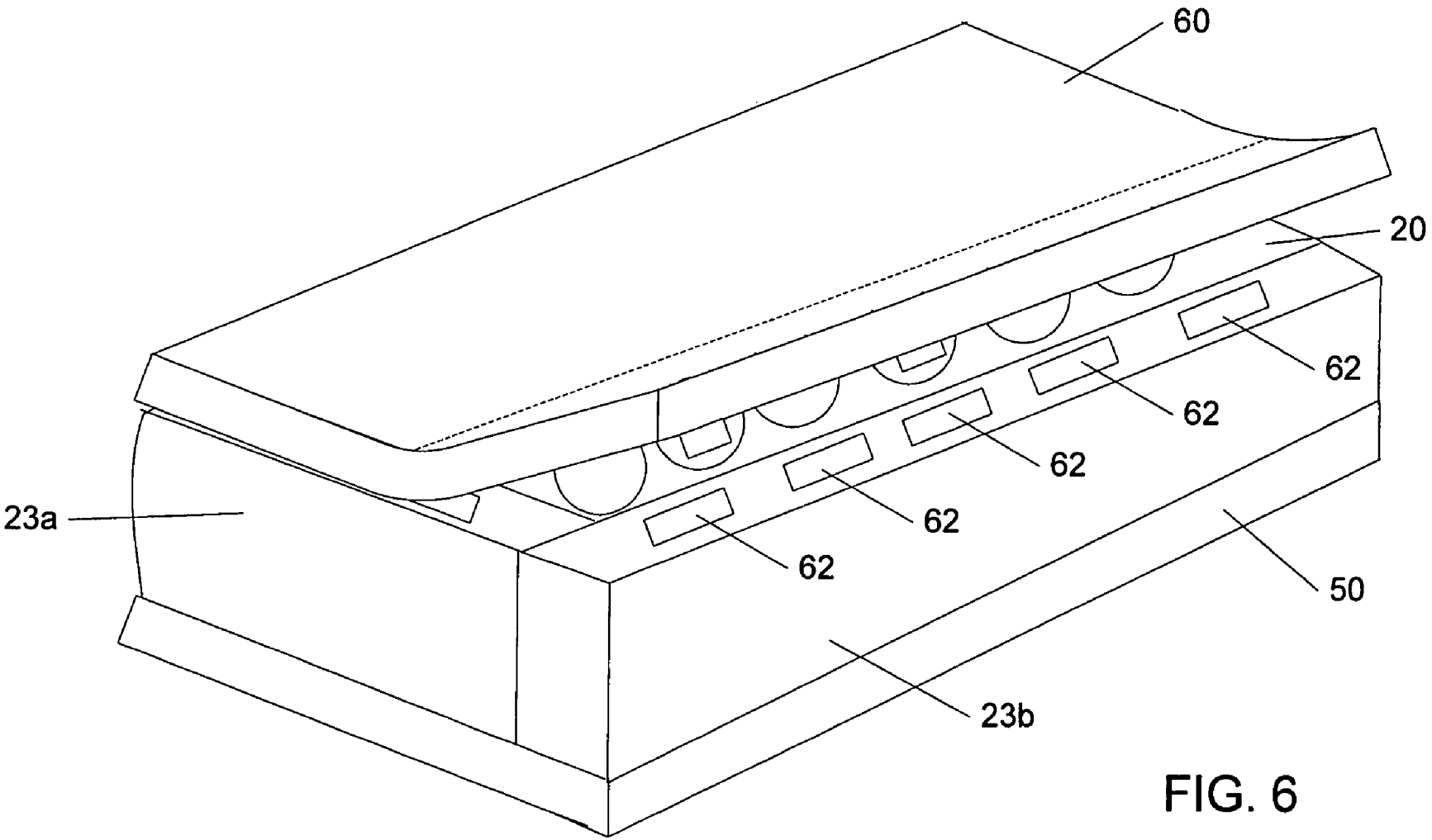
FIG. 6 shows application of a bottom deck to the innerspring unit (optional)

As shown in FIG. 6, to manufacture a two-sided mattress, the mattress assembly can then be turned over and patches 62, 64 can be applied to the side rails 23*a*, 23*b*, and to the bottom of innerspring unit 20, respectively, for at least temporarily securing a bottom upholstery foam or deck 60 to the bottom side of the mattress assembly, in the same manner as described above with reference to FIG. 5. The bottom upholstery foam 60 is optional and may be omitted, for example, for a one-sided mattress construction.

At this stage of the manufacturing process, the mattress assembly is held together by the adhesive patches which provide sufficient rigidity and strength during manufacture, but may not be able to withstand the forces and stresses exerted on the mattress during normal use. However, the mattress assembly can now be easily handled as a unit without the risk of misaligning the components during the manufacturing process.

Figure 7:
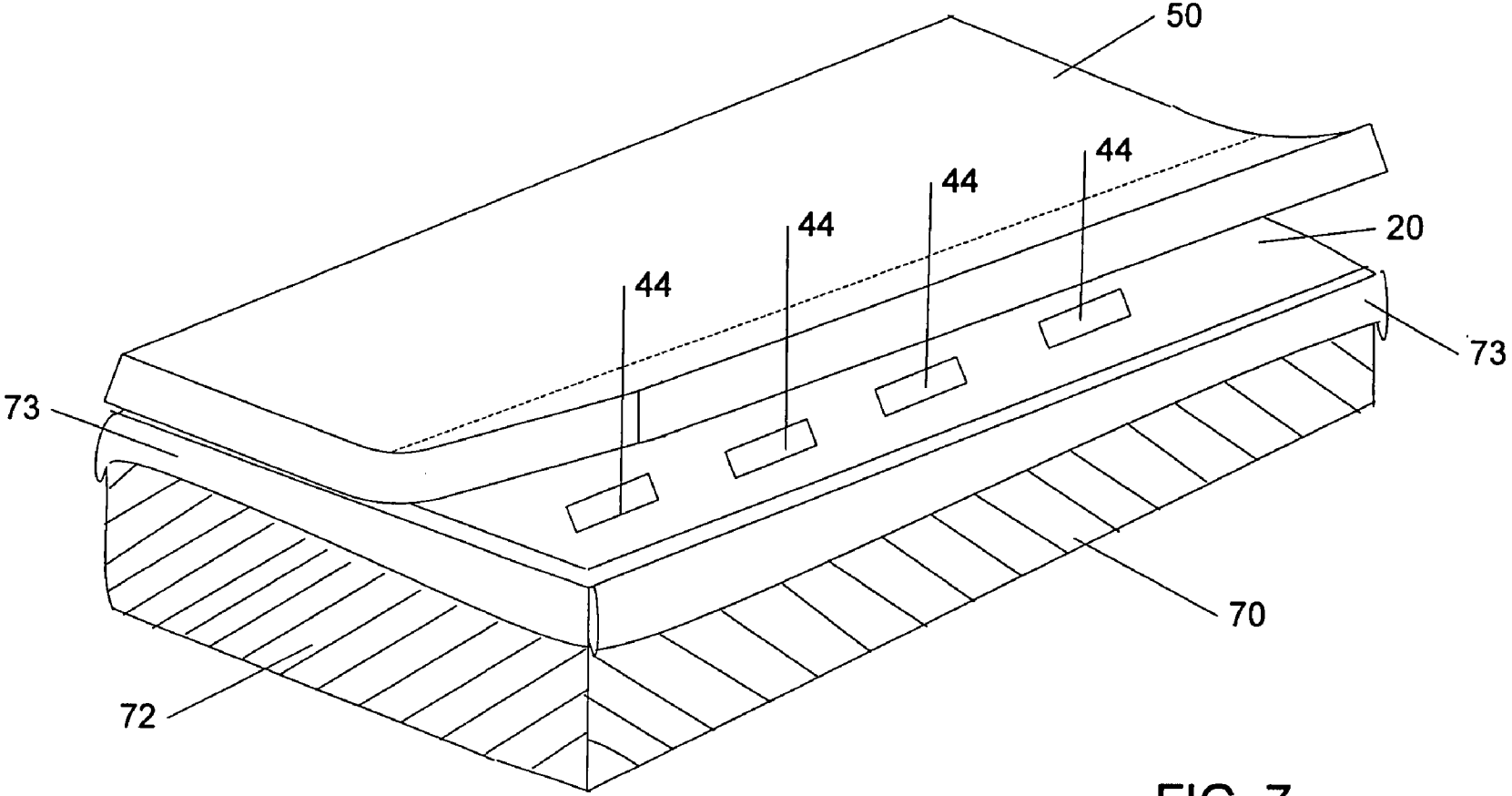
FIG. 7 shows application of top deck with side panels installed.

FIG. 7 shows an embodiment of a mattress assembly 70 with side panels 72 installed over the side rails 23*a*, 23*b* and a V-flap 73 used in a finishing step for permanently installing a quilted top panel. As discussed before with reference to FIG. 5, top panel 50 is at least temporarily attached to innerspring unit 20 (or to another deck layer previously installed over the innerspring unit 20) by adhesive patches 44.

Figure 8:
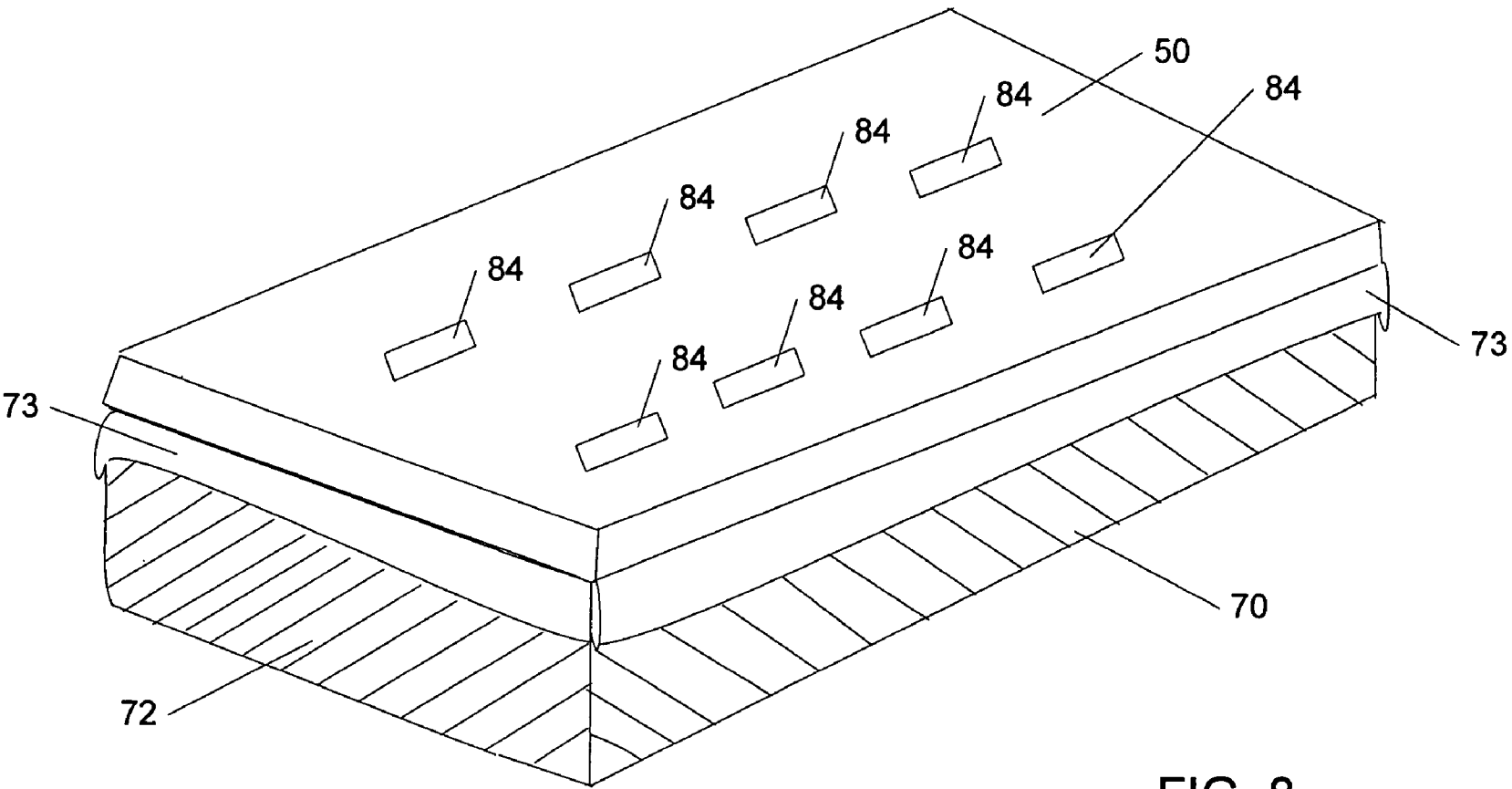
FIG. 8 shows application of adhesive patches to top deck for placement of quilted top panel.
Figure 9:
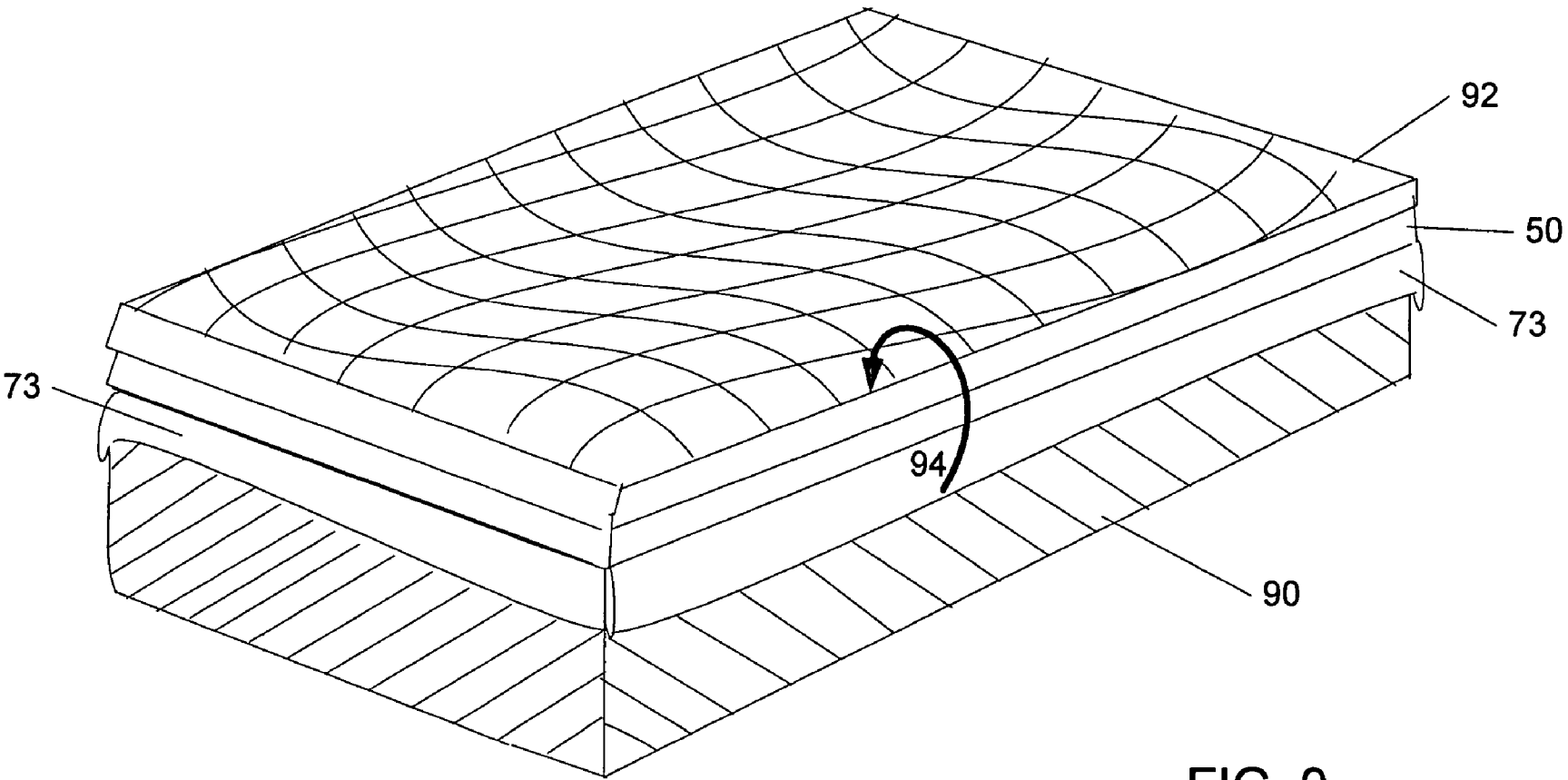
FIG. 9 shows a mattress construction complete and ready for closing by sewing.

As shown in FIG. 8 and also to FIG. 9, adhesive patches 84 are applied to top of foam layer 50 for placement of ticking and/or a quilted upholstery layers 92 on top of foam layer 50. All components of the mattress assembly 90 are thereby properly placed relative to each other and prevented from moving during final assembly. The V-flap 73 can then be inverted by folding it upward towards the upholstery top 92 in the direction of arrow 94, whereafter the upholstery layer 92 can be sewn and/or stitched using thread and/or yarn, stapled or otherwise joined to the exterior surface of the side panel, for example, the V-flap 73.

The adhesive patches no longer perform a useful function after the mattress is closed by sewing, so that the durability, bonding strength and wear resistance of the adhesive strips are immaterial for the performance of the mattress. The adhesive patches are only used for assembly of the mattress as a temporary placeholder.

In one embodiment, the pockets for the pocketed coils are formed of Duon material which has a tendency to bond more tightly with the adhesive patches. Other materials may be used, and in alternate embodiment, the coil of an open coil unit may be directly attached to the side rails and/or to the upholstery foam. In this way the coil unit can be joined to the support layer without the use of a border wire or hog rings. However, in alternate embodiments a border wire and hog rings may also be employed in cooperation with the adhesive patches, and the use of a border wire will depend on the particular application.

In other embodiments, the systems and methods described herein maybe used with two sided mattresses as well as mattresses that are capable of being used with adjustable beds. For example, a mattress for an adjustable bed may have a foam edge that has a break or a flexible component that is disposed somewhat midway along both long edges of the mattress. In this way, the adjustable bed will be more capable of pivoting around a central axis as the flexible portion built in the foam edge readily allows the mattress to pivot and bend.

It will be understood that any innerspring unit may be employed with the systems and methods described herein. Thus, open coils, pocketed coils, coils in foam, and even all foam units, which may include sections of different firmness, maybe used with the methods described herein.

When completed, the mattress, may have an upper sleep surface formed by a layer of foam padding 50 and a layer of ticking 92. In a one-sided mattress, a lower support layer may be foam, wood, plastic or a composite of such materials and typically will be covered by a thin layer of a non-woven sheeting. It may be a high density polyurethane foam having a density of approximately 1.85 lbs./cu. ft. and a firmness above 30 ILD. Other rigid materials may be used and may include plastic, wood, or other non-yielding rigid materials. To the extent such materials for the layer yield to pressure, such materials are to have at least a high degree of recoverability once the pressure has been removed so that the materials are not compacted.

The order in which the steps of the present method are performed is purely illustrative in nature. In fact, the steps can be performed in any order or in parallel, unless otherwise indicated by the present disclosure.

While particular embodiments of the present invention have been shown and described, it will be apparent to those skilled in the art that changes and modifications may be made without departing from this invention in its broader aspect. Therefore, the appended claims are to encompass within their scope all such changes and modifications as fall within the true spirit of this invention.

We claim:

1. A method of manufacturing a mattress, comprising:

providing a mattress core, at least one side rail, and at least one upholstery cover defining a sleep surface;

placing adhesive patches on surfaces of the at least one side rail and the mattress core;

at least temporarily attaching with the adhesive patches said at least one side rail to lateral surfaces of the mattress core to hold the side rails in place relative to the mattress core during assembly of the mattress, at least temporarily attaching with the adhesive patches said at least one upholstery cover to a major surface of the mattress core to hold the at least upholstery cover in place relative to the mattress core during assembly of the mattress; and permanently attaching an edge portion of the upholstery cover to an edge portion of the at least one side rail.

2. The method of claim 1, further comprising before attaching the upholstery cover, disposing an deck layer on the mattress core, said deck layer at least temporarily attached with the adhesive patches to a major surface of the mattress core to hold the deck layer in place relative to the mattress core during assembly of the mattress, and placing adhesive patches on the deck layer for at least temporarily attaching with the adhesive patches said at least one upholstery cover to the deck layer to hold the at least upholstery cover in place relative to the mattress core during assembly of the mattress.

3. The method of claim 1, wherein permanently attaching includes fastening the edge portion of the upholstery cover to the edge portion of the at least one side rail by sewing or stitching, or both.

4. The method of claim 1, wherein permanently attaching includes fastening the edge portion of the upholstery cover to the edge portion of the at least one side rail with staples.

5. The method of claim 1, wherein the adhesive patches comprise a material having opposing adhesive surfaces.

6. The method of claim 5, wherein the adhesive patches are provided on a non-stick backing.

7. The method of claim 5, wherein the adhesive patches are provided in form of rubber-based pressure sensitive adhesive patches.

8. The method of claim 1, wherein the edge portion of the at least one side rail includes a V-flap, and the edge portion of the upholstery cover is attached to the edge portion of the at least one side rail by folding the V-flap upward towards the edge portion of the upholstery cover.

9. The method of claim 1, wherein the adhesive patches have lateral dimensions that are substantially less than a dimension of the mattress.

10. The method of claim 1, wherein the adhesive patches have a length that are substantially equal to a length or a width of the mattress.

11. The method of claim 1, wherein the mattress core comprises a plurality of spring coils.

12. The method of claim 11, wherein the mattress core is selected from the group of open coil mattress core, fabric-encased spring coil mattress core, and springs in foam mattress core.

13. The method of claim 1, wherein the mattress core comprises a block of resilient foam.

14. The method of claim 9, wherein the at least one side rail comprises a plurality of side rail sections.

15. A mattress comprising a mattress core;

at least one side rail joined to the mattress core by one or more adhesive patches having a bonding strength sufficient to maintain a relative position between the mattress core and the at least one side rail at least during assembly of the mattress, at least one deck applied at least over an area of the mattress core and joined to the mattress core by one or more adhesive patches having a bonding strength sufficient to maintain a relative position between the mattress core and the at least one deck at least during assembly of the mattress; and an upholstery layer defining a sleep surface applied over the at least one deck and joined to the at least one deck by one or more adhesive patches having a bonding strength sufficient to maintain a relative position between the at least one deck and the upholstery layer at least during assembly of the mattress;

wherein said upholstery layer is permanently secured to the at least one side rail by an mechanical fastener.

16. The mattress of claim 15, wherein the mattress core comprises pocketed springs.

17. The mattress of claim 15, wherein the mechanical fastener is selected from the group consisting of thread, yarn, and staples.

18. The mattress of claim 15, wherein the adhesive patches comprise a double-sided adhesive tape.

19. The mattress of claim 15, wherein the adhesive patches comprise a double-sided foam mounting tape.

20. The mattress of claim 15, wherein the adhesive patches comprise pre-extruded rubber-based pressure sensitive adhesive patches.

21. The mattress of claim 15, wherein the at least one side rail includes an edge portion with a V-flap, and wherein an edge portion of the upholstery cover is permanently attached to the V-flap.

22. The mattress of claim 15, wherein the adhesive patches have lateral dimensions that are substantially less than a dimension of the mattress.

23. The mattress of claim 15, wherein the adhesive patches have a length that are substantially equal to a length or a width of the mattress.

* * * * *